US005170942A

United States Patent [19]

Spink et al.

[11] Patent Number: 5,170,942

[45] Date of Patent: Dec. 15, 1992

[54] SPRAY NOZZLE DESIGN

[75] Inventors: Donald R. Spink; Gordon P. Janes, both of Waterloo, Canada

[73] Assignee: Turbotak Technologies Inc., Waterloo, Canada

[21] Appl. No.: 753,404

[22] Filed: Aug. 30, 1991

[30] Foreign Application Priority Data

Sep. 3, 1990 [GB] United Kingdom ..... 9019188

[51] Int. Cl.[5] ..... B05B 7/08

[52] U.S. Cl. ..... 239/427.3; 239/427; 239/431; 239/434

[58] Field of Search ..... 239/427, 427.3, 431, 239/434, 430, 132.3, 523

[56] References Cited

U.S. PATENT DOCUMENTS

| | | | |
|---|---|---|---|
| 2,933,259 | 4/1960 | Raskin | 239/431 |
| 3,747,860 | 7/1973 | Habers | 239/431 |
| 3,844,485 | 10/1974 | Waggoner | 239/427 |
| 4,356,970 | 11/1982 | Vosper et al. | 239/427.3 |
| 4,601,428 | 7/1986 | Kurogo | 239/427.3 |
| 4,614,490 | 9/1986 | Kiczek et al. | 239/431 |
| 4,625,916 | 12/1986 | Nieuwkamp et al. | 239/431 |
| 4,708,293 | 11/1987 | Graziadio et al. | 239/427 |
| 4,819,878 | 4/1989 | Bailey et al. | 239/427 |
| 4,890,793 | 1/1990 | Fuglistaller et al. | 239/427 |
| 4,893,752 | 1/1990 | Spink et al. | 239/427.3 |
| 5,025,989 | 6/1991 | Spink et al. | 239/431 |

FOREIGN PATENT DOCUMENTS

| | | |
|---|---|---|
| 2627880 | 12/1977 | Fed. Rep. of Germany . |
| 188368 | 11/1922 | United Kingdom . |

*Primary Examiner*—Andres Kashnikow
*Assistant Examiner*—Lesley D. Morris
*Attorney, Agent, or Firm*—Sim & McBurney

[57] ABSTRACT

Novel cluster nozzle designs useful for the formation of atomized sprays of fine liquid droplets in a continuous gas phase are described. A plurality of individual gas-liquid mixing zones communicate with a common source of liquid and a common source of gas to form gas-liquid mixtures for spraying from individual orifices in the nozzle. An improved uniformity of spray pattern is attained, as well as the ability to effect a greater liquid output from the nozzle through the use of larger size or numbers of orifices, while retaining very uniform sprays, by effecting a degree of premixing of liquid and gas before passage to the individual gas-liquid mixing zones.

20 Claims, 7 Drawing Sheets

SPRAY NOZZLE DESIGN

FIELD OF THE INVENTION

The present invention relates to an improved design of spray nozzles which produce an atomized spray.

BACKGROUND TO THE INVENTION

In German Patent No. 2,627,880, there is described a nozzle design for forming atomized sprays in which a gas medium and a liquid medium are combined in a mixing chamber and then expelled from the nozzle as atomized liquid or as tiny gas bubbles, depending on the relative proportions of the liquid and gas and whether sprayed into a gaseous or liquid medium. The atomization results from a considerable drop in pressure as the two-phase mixture leaves the nozzle. The nozzle is based on the principle that a properly-formed two-phase mixture has an effective sonic velocity that is only a fraction of the sonic velocity of the two pure phases. For example, the speed of sound for clean water under normal conditions is 1500 m/s and for clean air approximately 330 m/s. The speed of sound of a defined two-phase mixture is approximately 20 to 30 m/s. This nozzle design has many attributes, including lower operating pressures, lower pressure drop, reduced velocities, reduced air consumption and reduced orifice abrasion.

However, the nozzle consists of a single orifice which has many shortcomings. For example, if a large duct is to be completely filled with fine liquid spray, the 12° to 15° spray angle generated by the single orifice may require placement of the nozzle many meters back in the duct or the use of a multiple number of individual nozzles to achieve the objective.

In the nozzle design described in the above-noted German Patent, the liquid feed is effected through the same pipe as the spray is ejected from, while the gas is fed from the side to a chamber which surrounds and communicates with the liquid feed through a plurality of openings in the liquid feed pipe just upstream of the orifice, so as to form the two-phase mixture therein. This feed arrangement often is unsuitable for the feed lines available and the intended end use.

U.S. Pat. No. 4,893,752, assigned to the assignee hereof, describes a number of novel nozzle designs intended to overcome the drawbacks of the nozzle design of German Patent No. 2,627,880 by providing a multiple number of orifices communicating with a single source of both liquid and gas and arranged to spray in different directions away from the nozzle. These nozzle designs can be termed "cluster nozzles".

The cluster nozzle designs of U.S. Pat. No. 4,893,752 were developed to serve various applications for the nozzles in terms of quantity of liquid to be sprayed from a single nozzle, angle of spray pattern required, density of spray within the spray pattern, spray droplet size distribution desired, whether a clean liquid or a slurry was to be sprayed, and where the spray was to be introduced to the system.

More demanding requirements now are being required to be met for the cluster nozzle designs. These requirements generally relate to the quantity of liquid to be sprayed from a single nozzle, the density and angle of the spray pattern to be delivered and the droplet size distribution to be generated.

An increase in the amount of liquid to be sprayed can be met generally by an increase in size of the orifices in the nozzle or by adding more orifices of the same size.

While single orifice nozzles may range up to 35 mm in size (I.D. of the orifice), the standard nine orifice cluster nozzles (designed as seen in FIGS. 3 and 4 of U.S. Pat. No. 4,893,752) with orifices larger than 8 or 9 mm do not perform as well as a similar nozzle with 8 mm or smaller orifices. This observation, in effect, has placed a limitation on the quantity of liquid that can be effectively sprayed from a single nozzle. The main deficiency observed, say for a nine orifice nozzle where the orifices were 10 mm, was a very non-uniform distribution of liquid emanating from each of the orifices.

It is also observed that, as more orifices are used in the cluster nozzles of U.S. Pat. No. 4,893,752, the orifices must be smaller yet if uniform spray patterns are to be obtained. Thus, a 16×6 mm cluster nozzle was designed for a particular application but did not produce the degree of spray uniformity desired. A nozzle with 16×6 mm orifices installed in three concentric rings about the axis of the nozzle was built with each orifice preceded by a chamber where the liquid was introduced at the end opposite the orifice, via a separate liquid chamber, into a mixing section where the atomizing gas was introduced radially into the liquid flow through a plurality of orifices which were fed gas from the chamber communicating with a source of gas. The gas and liquid form a two-phase mixture within the mixing chambers which is subsequently ejected through the orifice whereupon a spray is produced. In this case, we were able to produce a wider spray angle while significantly increasing the density of spray droplets within the spray pattern. However, we were still able to detect some degree of variability emanating from the orifices.

In U.S. Pat. No. 4,893,752, there is also disclosed a two-phase nozzle wherein a single mixing chamber is employed wherein the liquid and gas streams are joined to form a two-phase mixture, the mixture then being directed to an array of orifices located as desired at the delivery end of the nozzle (see FIGS. 5 and 6 of the U.S. Pat. This structure is claimed in U.S. Pat. No. 5,025,989 divided out of U.S. Pat. No. 4,893,752). Within certain constraints, this embodiment of the cluster nozzle has been found to produce excellent sprays which are comparable to the sprays delivered from nozzles where a separate mixing chamber preceded each individual orifice (as in FIGS. 3 and 4 of U.S. Pat. No. 4,893,752). However, the constraints experienced were similar to those found for the standard cluster nozzle, i.e. one with individual gas-liquid mixing chambers for each orifice, namely, less than perfect sprays emanating from each orifice as their size and the amount of liquor being sprayed increased.

SUMMARY OF INVENTION

In accordance with the present invention, we have now surprisingly found that there can be achieved a significantly-improved performance of multi-orifice nozzles of the type wherein individual gas-liquid mixing chambers are provided for each orifice. This improved performance is achieved by introducing gas into the liquid chamber prior to distribution of liquid to the individual mixing chambers, to effect a pre-mixing of gas and liquid. Gas is introduced to the liquid in two stages, first in the liquid chamber and then in the individual gas-liquid mixing chambers.

This seemingly simple structural modification to the cluster nozzle design produces an exceptionally uniform spray from each orifice. As a result, it is possible to increase significantly the amount of liquid to be sprayed from the cluster nozzle, either by increasing the size or number of individual orifices, without impairing the quality of the spray.

Accordingly, in one aspect of the present invention, there is provided a nozzle for the formation of an atomized spray of fine liquid droplets in a continuous gaseous phase or of fine gas bubbles in a continuous liquid phase, which comprises first chamber means for communicating with a source of liquid, second chamber means for communicating with a source of gas, and passage means extending between the second chamber means and the first chamber means for pre-mixing said gas and liquid in said first chamber means to form a first mixture of gas and liquid. A plurality of individual mixing chamber means communicate with both the first and second chamber means for mixing the gas from said second chamber means and the first gas-liquid mixture from the first chamber means to form an equilibrium two-phase mixture of gas and liquid in each of the individual mixing chamber means for ejection from the nozzle. A plurality of orifice means is located downstream of and communicates with the plurality of individual mixing chamber means for ejection of the two-phase mixture from each of the individual mixing chamber means to form the atomized spray.

The present invention also includes, in another aspect, a method of forming an atomized spray of fine liquid droplets in a continuous gaseous phase or of fine gas bubbles in a continuous liquid phase by a plurality of steps. A liquid and a gas are fed to a first gas-liquid mixing zone and a first mixture of gas and liquid is formed in the first gas-liquid mixing zone. The first gas-liquid mixture and a gas are fed to a plurality of individual second gas-liquid mixing zones and an equilibrium two-phase mixture of gas and liquid is formed in each of the individual second gas-liquid mixing zones. The two-phase mixture is ejected from each of the individual second gas-liquid mixing zones through orifices to form the atomized spray.

In addition to the ability to increase the amount of liquid to be sprayed from the nozzle by the staged mixing of gas with liquid, and quite unexpectedly, the addition of gas, usually compressed air, to the liquid chamber as well as to individual mixing chambers associated with each orifice had no significant effect on the total amount of gas consumed per nozzle. Therefore, it has been concluded that the manner of introduction of the gas to the liquid chamber is not critical. Accordingly, the present invention also provides a three-stage introduction of gas to the liquid as an additional embodiment of the atomizing nozzles to ensure the formation of an equilibrium two-phase mixture especially when larger volumes of liquid are to be sprayed from a single multi-orifice nozzle.

While the applicants do not wish to be bound by any theory to explain the results obtained by the nozzle design provided herein, it is thought that the effectiveness of the design relates to the kinetics of the formation of two-phase gas/liquid mixtures. Where relatively large flows of liquid must form a suitable two-phase mixture while flowing through the confines of a relatively small diameter pipe, it is probable that the retention time in the mixing chamber needs to be increased.

This theory also suggests other approaches additional to that adopted here, namely increasing the length of the gas-liquid mixing chamber or increasing the diameter of the mixing chamber, thereby providing more time to achieve the correct degree of two-phase formation. However, both approaches require an increased nozzle size, in terms of diameter and/or length, increasing the cost and complexity of producing the nozzle.

In contrast, the modification provided herein has no effect on nozzle size and very little effect on the cost of the nozzle and hence is highly to be preferred.

DESCRIPTION OF PREFERRED EMBODIMENT

Figure 1:
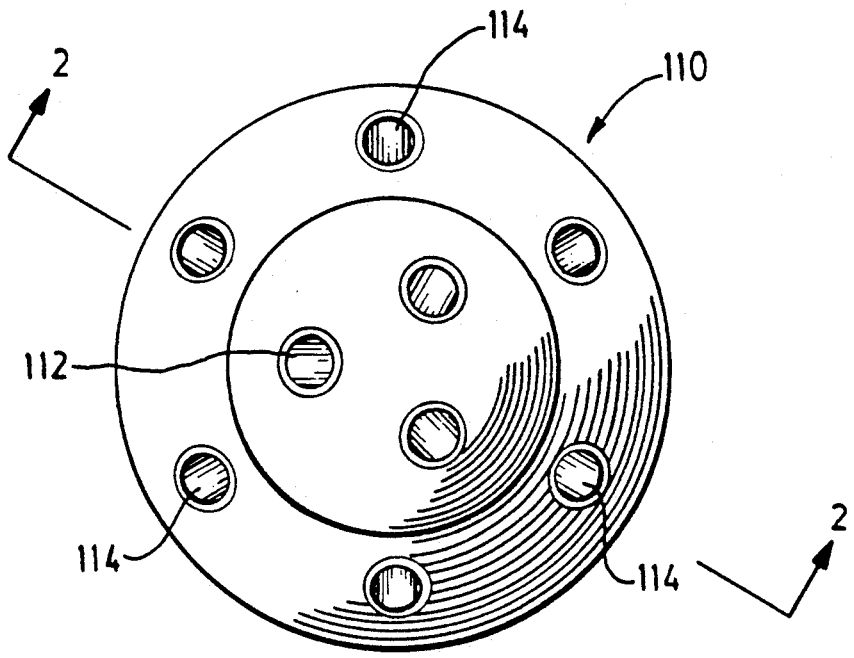
FIG. 1 is a plan view of a nozzle design in accordance with one embodiment of the invention.
Figure 2:
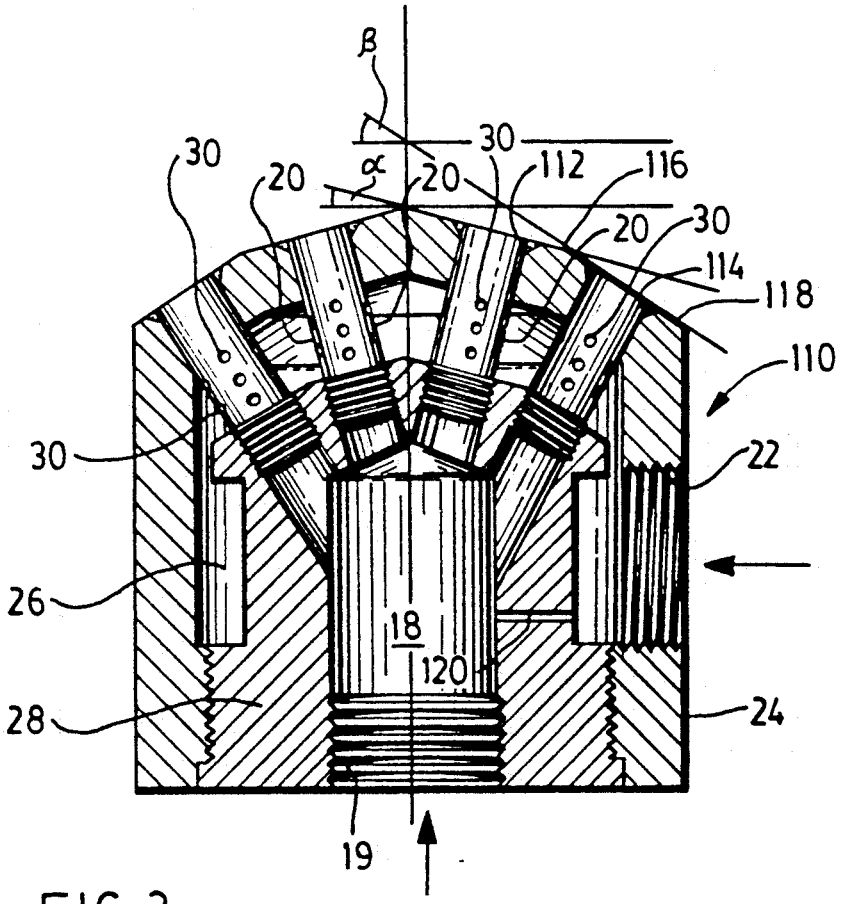
FIG. 2 is a sectional view taken on line 2—2 of FIG. 1.

Referring first to FIGS. 1 and 2 of the drawings, there is illustrated therein one embodiment of multiple orifice cylindrical nozzle 110 according to the invention. As may be seen, the nozzle 110 has two circularly-arranged sets of orifices 112 and 114. The inner set of orifices 112 is formed in a first tapered external surface 116 of the nozzle 110 arranged at an angle $\alpha$ to a line drawn perpendicularly to the axis of the nozzle 110. The outer set of orifices 114 is formed in a second tapered external surface 118 of the nozzle 110 arrange an angle $\beta$, greater than angle $\alpha$, to a line drawn perpendicular to the axis of the nozzle 110. By providing two sets of orifices arranged at different angles, the total spray angle generated by the nozzle 110 can be varied widely while at the same time effectively eliminating spray pattern interference.

The angle $\alpha$ generally is small so that the orifices 112 fill the center of the total spray being generated. The angle $\beta$ is designed to provide the overall spray angle desired, which may vary with nozzle 110 for about 30° to about 180°.

If a larger, more dense spray is required, a further set of orifices may be provided, say from 9 to 12 in number, arranged in the circular array on a tapered surface with a taper angle greater than angle $\beta$. The extent to which additional sets of orifices may be added to the nozzle 110 on tapered surfaces having increasing angles of taper was previously limited by the ability to provide proper (equilibrium) two-phase mixtures for larger flow rates or nozzle (orifice) sizes.

The nozzle 110 has an interior axial chamber 18 which is intended to be connected to a liquid flow line through liquid inlet 19 in the bottom wall of nozzle 110. Each of the orifices 112, 114 is connected to the chamber 18 by an individual pipe 20 to permit flow of liquid from the chamber 18 to the respective orifices 112 and 114.

An air or other gas inlet 22 is provided in the side wall 24 in communication with a second internal chamber 26 which is separated from the axial chamber 18 by an internal wall 28, which is a body part threadedly engaged or otherwise joined to the outer wall 24 of the nozzle 110. The chamber 26 communicates with the interior of the pipes 20 through a plurality of openings 30 extending through the wall of each of the pipes 20. For this reason, the pipes 20 also may be considered as air or gas distributors.

In operation, the liquid passing through the pipes 20 from the chamber 18 mixes with gas passing from the chamber 26 through the openings 30 to form a two-phase mixture in the pipe 20, which thereby functions as a mixing chamber for gas and liquid. As the mixture exits the nozzle 10 through the orifices 112, 114, the sudden change in pressure causes atomization to form fine liquid droplets in a continuous gaseous phase or fine gas bubbles in a continuous liquid phase, depending on the relative proportions of gas and liquid in the two-phase mixture. In most applications, proportions of gas and liquid are provided which produce a discontinuous phase of liquid droplets. Further particulars of the atomization procedure are described in German Pat. No. 2,627,880, referred to above and incorporated herein by reference.

In accordance with the present invention, a passage 120, or a plurality of such passages, is provided joining the gas entry port 22 to the liquid chamber 18 to permit air fed to the gas entry port 22 to pass to the liquid chamber 18 to effect a pre-mixing of gas and liquid, prior to passage of the premixture of gas and liquid to the pipes 20, wherein further mixing of gas and liquid occurs to form an equilibrium two-phase gas-liquid mixture to be sprayed from the orifices 112, 114. The presence of this passage 120 provides an improvement in spray quality obtained from the nozzle, particularly when larger amounts of liquid are required to be sprayed from the nozzle, as is the case when the number and/or size of the individual orifices 112, 114 is increased.

For larger nozzles or those spraying larger volumes of liquid, the passage 120 may be supplemented by one or more additional passages communicating between the liquid chamber 18 and the gas chamber 26 to provide the desired degree of pre-mixing of gas and liquid.

The design illustrated in FIGS. 1 and 2 permits the multiple-orifice nozzle design to contain an indefinite number of orifices through the addition of third and even fourth rings of orifices without the short-comings discussed above, to provide wider spray angles and higher density and more uniform spray patterns. With suitable orifice distribution, the modified nozzle design may produce fan-shaped spray patterns with a high degree of uniformity of spray.

Figure 3B:
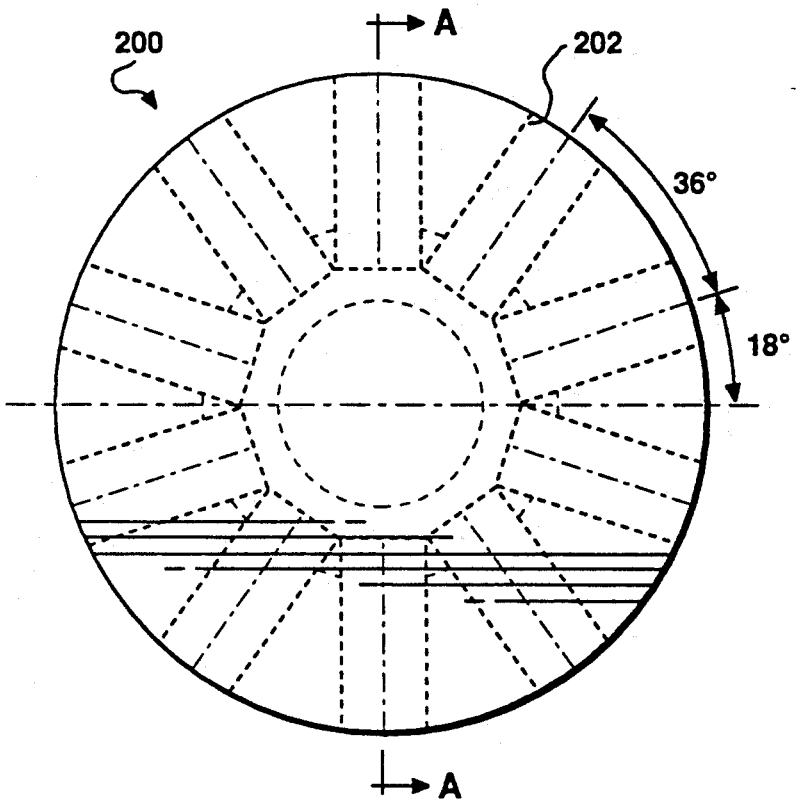
FIG. 3 contains sectional (FIG. 3A) and front elevational (FIG. 3B) views of a 360° spray nozzle provided in accordance with another embodiment of the invention.
Figure 3A:
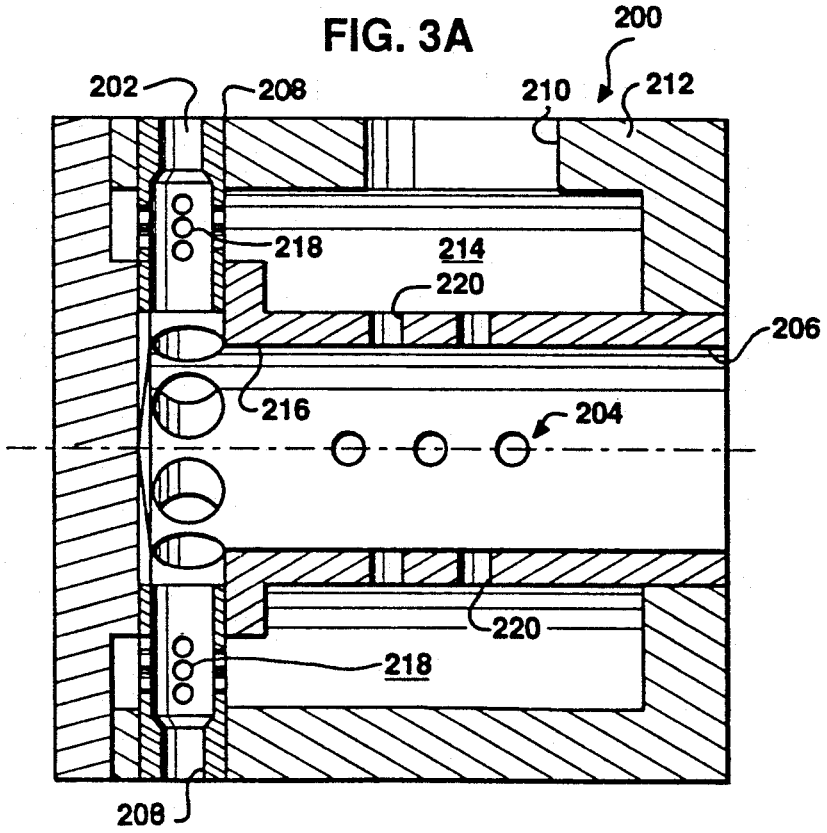

Turning now to FIG. 3, there is illustrated therein a 360° spray nozzle 200 in which all of the orifices are placed normal to the axis of the nozzle or duct, provided in accordance with a further embodiment of the invention.

The nozzle 200 has a plurality of equally-arcuately spaced orifices 202 arranged normal to the axis of the nozzle. The nozzle 200 has an interior axial chamber 204 which is intended to be connected to a liquid flow line through a liquid inlet 206. Each of the orifices 202 is connected to the chamber 204 by an individual pipe 208 to permit flow of liquid from the chamber 204 to the respective orifices 202.

An air or other gas inlet 210 is provided in the side wall 212 in communication with a second internal chamber 214 which is separated from the axial chamber 204 by an internal wall 216.

The chamber 214 communicates with the interior of pipes 208 through a plurality of openings 218 through the wall of each of the pipes 208. In accordance with the invention, a plurality of passages 220 is provided joining the air chamber 214 to the liquid chamber 204 to permit air fed to the gas entry port 210 to pass to the liquid chamber 204 as well as to the interior of the pipes 208.

The nozzle 200 operates in analogous manner to the nozzle 110 described above with respect to FIGS. 1 and 2 and reference may be had to that description. Accordingly, gas and liquid are premixed in the chamber 204 and the premixture passes to the plurality of individual pipes 202, wherein further mixing with gas occurs to form an equilibrium two-phase mixture under the conditions of flow and pressure before ejection of the atomized spray from the plurality of individual orifices 202.

The configuration shown in FIG. 3 makes possible improved gas quenching, for example, at the inlet of a scrubber for solute gases and/or particulates in a gas stream where very hot gases, e.g. 2000° F., are encountered. The spray nozzle 200 can be placed very close to the gas entry point without spraying water onto brick-/ceramic lining of a duct carrying the hot gas stream to the scrubber.

Figure 4A:
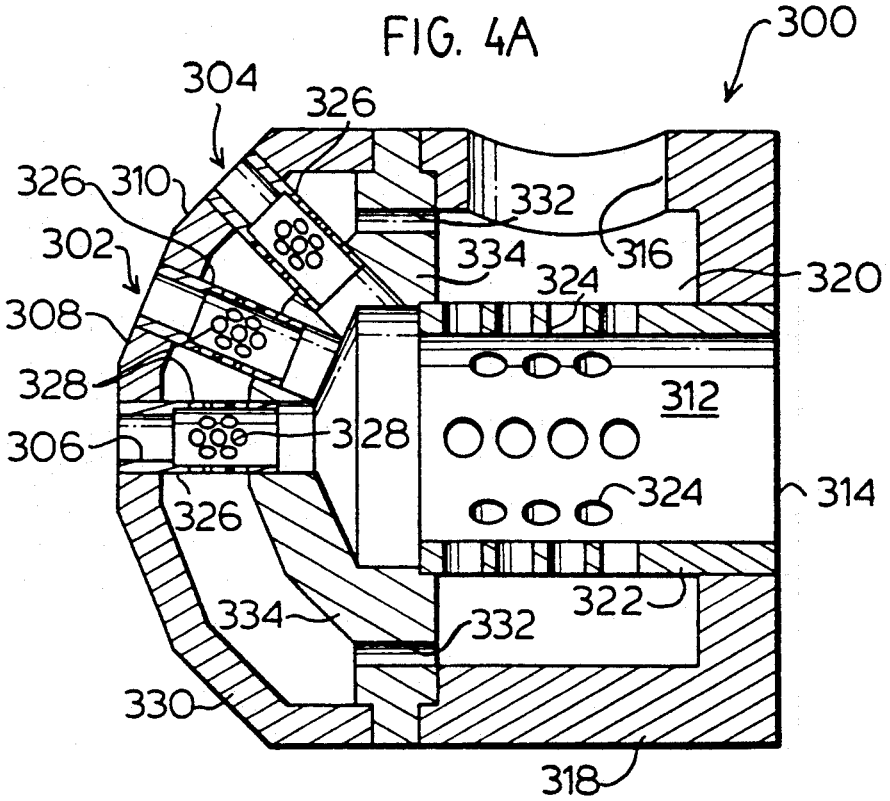
FIG. 4 contains sectional (FIG. 4A) and front elevational (FIG. 4B) views of a sixteen-orifice nozzle constructed in accordance with a further embodiment of the invention.
Figure 4B:
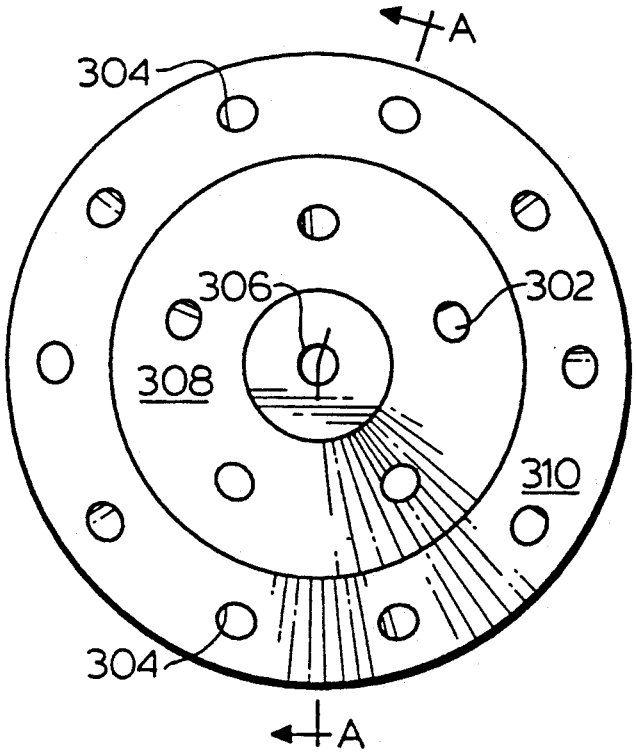

In FIG. 4, there is illustrated a further embodiment of nozzle similar to that illustrated in FIGS. and 2 but in this case there are a significantly increased number of nozzle orifices, which is made possible by providing premixing of some of the gas with the liquid.

As seen therein, a nozzle 300 has two circularly-arranged sets of orifices 302, 304 with the individual orifices in each set being equally arcuately spaced. This nozzle 300 also is illustrated possessing an axial orifice 306, but this orifice may be omitted, if desired. The spray formed by the axial orifice 306 tends to draw in adjacent sprays, thereby decreasing the total spray angle produced by the nozzle. While this effect may represent a problem with small numbers of orifices, as described in the aforementioned U.S. Pat. No. 4,893,752, the effect may be used beneficially where larger numbers of orifices are employed, as the improvements of the present invention permit, to achieve a higher spray density.

The inner set of five orifices 302 is formed in an external surface 308 which is arranged at a first angle to the axis of the nozzle while the outer set of ten orifices 304 is formed in an external surface 310 which is arranged at a steeper angle, in analogous manner to surfaces 116 and 118 in the embodiment of FIGS. 1 and 2.

The nozzle 300 has an interior axial chamber 312 which is intended to be connected to a liquid flow line through inlet 314. An air or other gas inlet 316 is provided in the side wall 318 of the nozzle 300 in communication with a second internal chamber 320 which is separated from the axial chamber 312 by an internal wall 322.

A plurality of openings 324 is provided through the internal wall 322 to permit air to pass from the second internal chamber 320 to the axial chamber 312 to form a first mixture of gas and liquid in the axial chamber 312.

Each of the orifices 302, 304, 306 is connected to the downstream end of the axial chamber 312 by a individual pipe 326 to permit flow of the first gas-liquid mixture from the axial chamber 312 through the individual pipes 326 to the various orifices 302, 304, 306.

A plurality of openings 328 is provided through the wall of each of the individual pipes 326 so as to effect communication between an air chamber 330 and the internal region of each of the individual pipes 326. This arrangement permits air in the chamber 330 to pass into the individual pipes 326, so as to form with the first gas-liquid mixture received from the axial chamber 312 an equilibrium two-phase mixture in each of the individual pipes 328 for ejection from the orifices 302, 304, 306.

The air chamber 330 communicates with the second internal chamber 320 by a plurality of axially-directed passages 332 through a dividing wall 334 to permit air fed through inlet 316 to the second internal chamber 320 to pass to the air chamber 330. This arrangement, whereby the chambers 320 and 330 are communicated by a ring of axially-directed passages 332 through the dividing wall 334, improves distribution and flow of compressed air within the nozzle structure 300, in comparison to the arrangement illustrated in FIGS. and 2, resulting in improved air balance within the nozzle. In addition, decreased air turbulence in the air chamber 330 results, thereby improving delivery of compressed air to the individual pipes 326 and decreasing energy loss from the improved fluid dynamics.

This arrangement for air distribution within the nozzle also may be employed with the multiple air distribution nozzle structure of U.S. Pat. No. 4,893,752 and constitutes a further aspect of the invention.

Figure 5A:
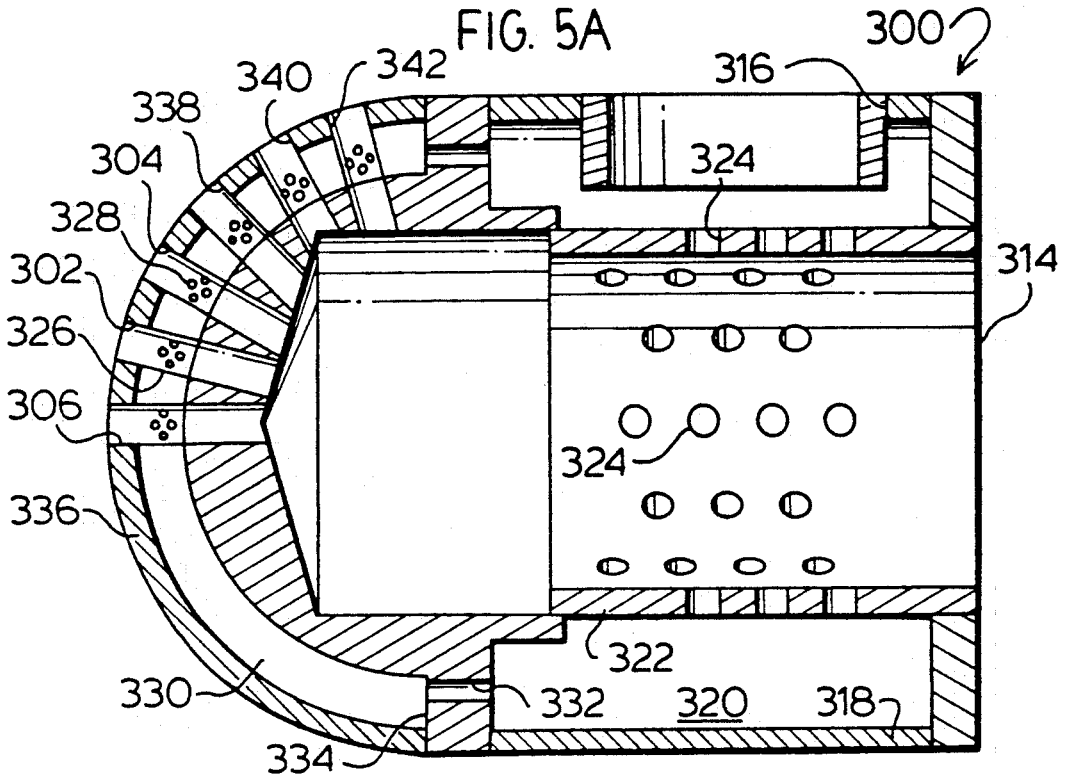
FIG. 5 contains sectional (FIG. 5A) and front elevational (FIG. 5B) views of a fifty-eight orifice nozzle constructed in accordance with an additional embodiment of the invention.
Figure 5B:
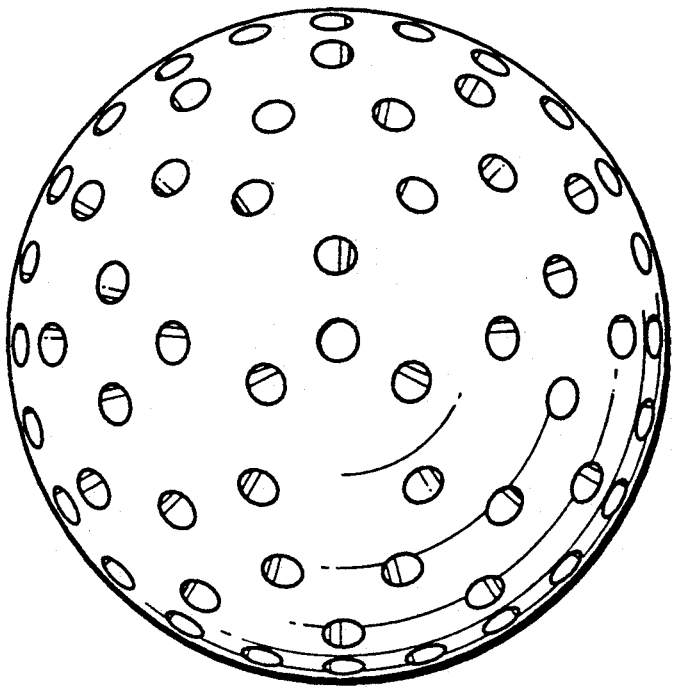

FIG. 5 shows the application of the principles of the invention to greater numbers of orifices, in this case numbering 58, provided in five circular groupings arranged at a different angle to the nozzle axis. Within each grouping, the orifices are equally-arcuately spaced. Reference numerals common to those employed for FIG. 4 are employed therein to describe the same elements. As in the case of FIG. 4, the axially-directed orifice 306 may be omitted.

In the embodiment of FIG. 5, the various orifices are illustrated as being formed in a domed head 336 to provide the different angles of projection of sprays from the nozzle for simplicity of illustration. However, the various groups of orifices usually are provided on flat surfaces provided at increasingly steeper angles for the respective groups of orifices.

The orifices in FIG. 5 are arranged in a first group 302 of three orifices, a second group 304 of six orifices, a third group 338 of twelve orifices, a fourth group 340 of twelve orifices and a fifth group 342 of twenty-four orifices. With the optional axial orifice 306, the total number of orifices illustrated is 58 while with the optional axial orifice 306 omitted, the total number of orifices becomes 57.

In the various illustrated embodiments, the orifices are shown as all having the same diameter, since this arrangement promotes a uniform droplet size distribution. However, in some instances, it may be desirable to produce a specific combination of larger and smaller liquid droplets from a cluster nozzle.

For example, in gas scrubbing, it is often desirable to introduce the spray counter-current to the gas flow to improve residence time as well as effect a more uniform distribution of the spray in the duct. However, when a fine spray is introduced within a duct and counter-current to the flow of gas, the spray often expands to such an extent that fifty to seventy percent of the liquid is deflected enough to impinge on the duct wall, where the droplets agglomerate and then coalesce to collect in the lower portion of the duct. To alleviate this situation, it may be desirable to spray somewhat larger droplets from those orifices located farthest from the axis of the nozzle and finer droplets from those orifices located closest to the axis of the nozzle.

Figure 8:
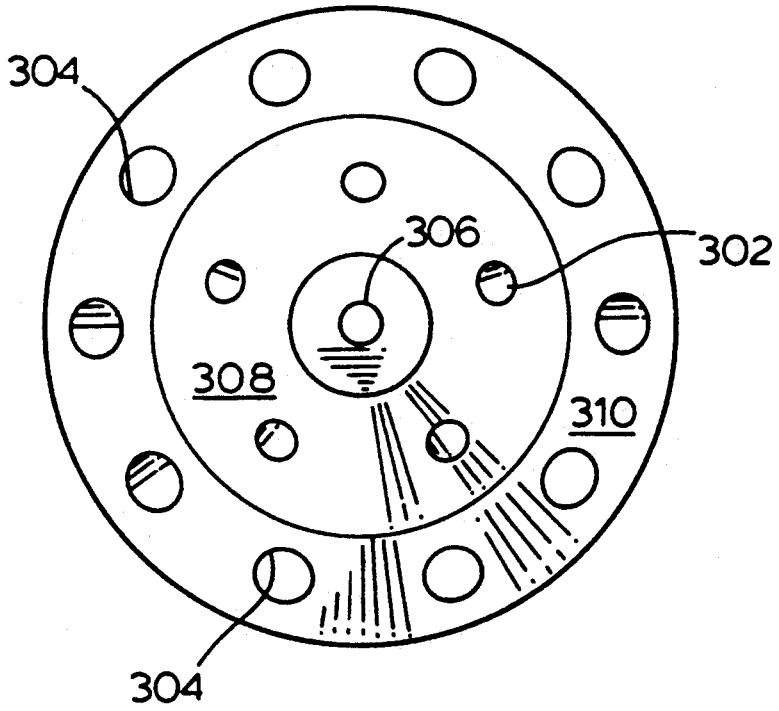
FIG. 8 is a front elevational view of a nozzle having an alternative orifice arrangement, useful in the various embodiments of the invention.

Such an effect can be achieved by providing orifices of corresponding larger or smaller diameter, with the outer orifices being of larger diameter than the inner orifices, as illustrated in FIG. 8. A reversal of this arrangement may be employed, if desired. A larger flow of liquid is sprayed per orifice where the larger diameter is employed. An inequality and lack of uniformity of flow that results can be compensated for by suitable adjustment of the number of orifices used on each level.

Further, the orifices in the various groupings generally are equally arcuately spaced from each other in order to obtain a uniform distribution of the sprays emanating from the orifices. However, for particular applications, it may be desired to provide a degree of lack of such uniformity by differently spacing the orifices.

Figure 6A:
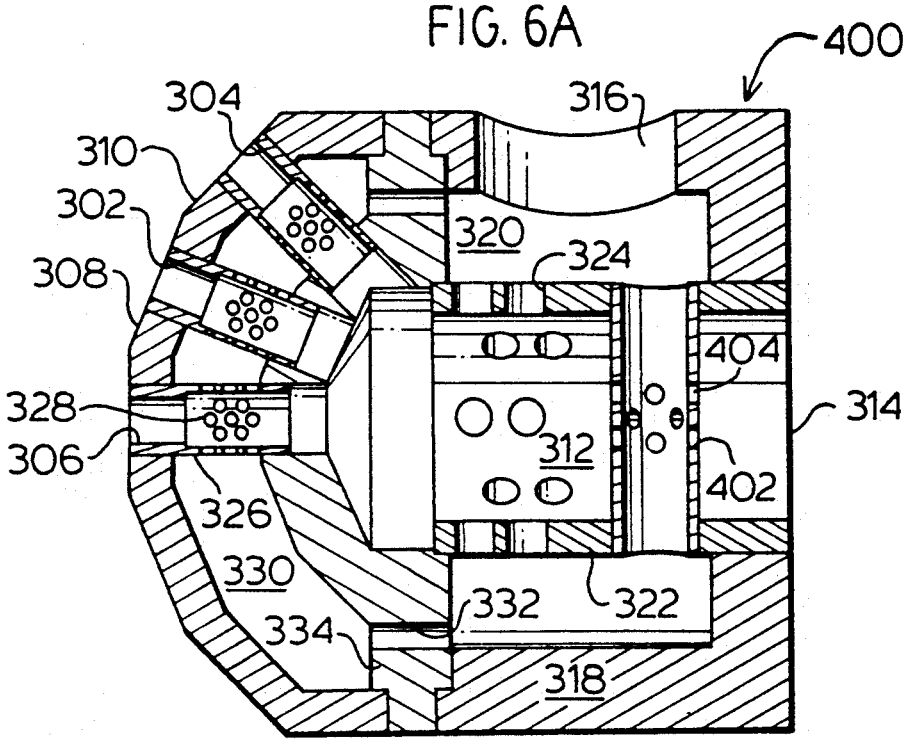
FIG. 6 contains sectional (FIG. 6A) and front elevational (FIG. 6B) views of a nozzle having tertiary-stage air introduction and constructed in accordance with a yet further embodiment of the invention.
Figure 6B:
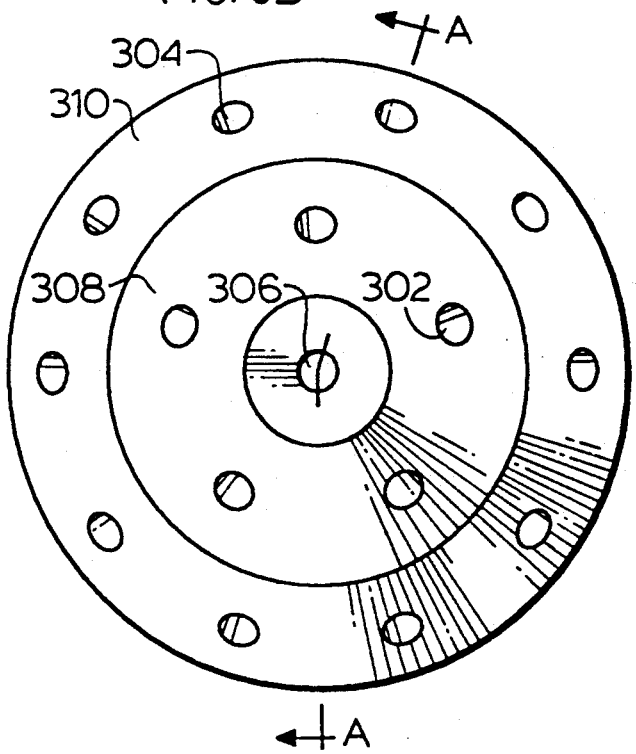
Figure 7A:
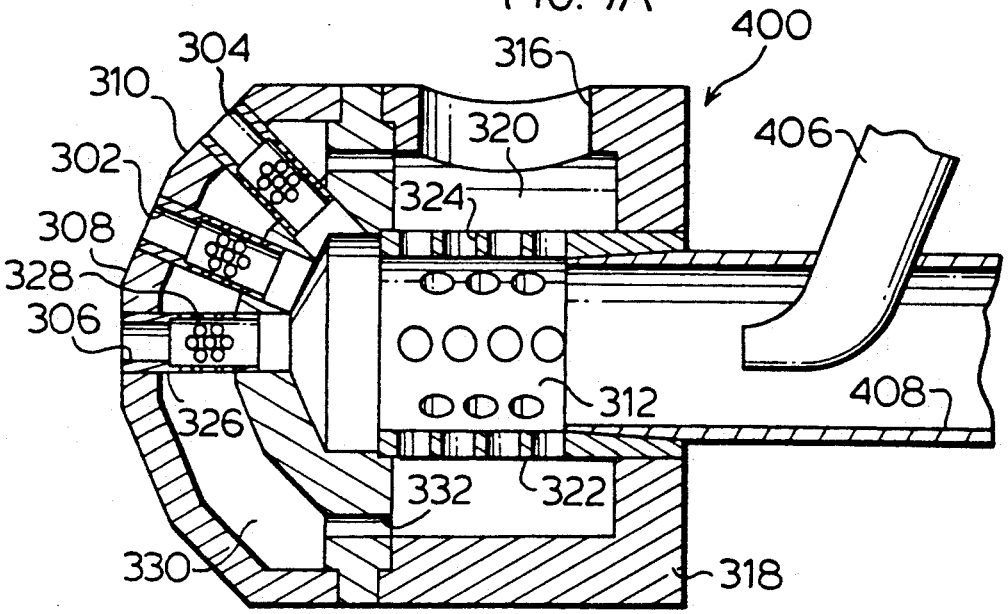
FIG. 7 contains sectional (FIG. 7A) and front elevational (FIG. 7B) views of a nozzle having an alternative form of tertiary air introduction to that shown in FIG. 6.
Figure 7B:
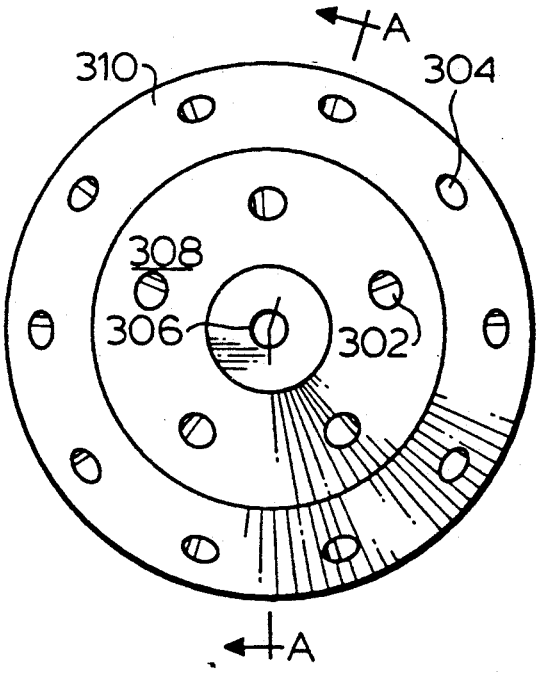

Turning now to FIGS. 6 and 7, these FIGS. illustrate two nozzles 400 according to further embodiments of the invention wherein further premixing of liquid and gas is effected. The structure illustrated is a modified form of the structure illustrated in FIG. 4 and common reference numerals are employed to describe common elements.

In FIG. 6, a pipe 402 extends transversely of the axial chamber 312 between opposite portions of the wall 322 thereof so as to communicate with the second internal chamber 320 and thereby provide a flow of compressed air to the interior of the pipe 402. The pipe 402 is provided with openings 404 through the wall thereof to permit compressed air to pass from the pipe 402 to the liquid flowing in the chamber 312, thereby effecting a further pre-mixing of gas and air within the nozzle 400.

In the embodiment of FIG. 7, a separate gas feed pipe 406 is provided, which feeds gas into the liquid feed pipe 408 before the liquid is introduced to the nozzle 400.

SUMMARY OF DISCLOSURE

In summary of this disclosure, the present invention provides a novel cluster nozzle design which provides for improved uniformity of spray pattern and which enables a greater liquid output to be attained through the use of larger size and numbers of orifices, while retaining very uniform sprays. Modifications are possible within the scope of this invention.

What we claim is;

1. A nozzle for the formation of an atomized spray of fine liquid droplets in a continuous gaseous phase or of fine gas bubbles in a continuous liquid phase, which comprises:

first chamber means for communicating with a source of liquid, second chamber means for communicating with a source of gas, passage means extending between said second chamber means and said first chamber means for premixing the gas and liquid in said first chamber means to form a first mixture of gas and liquid, a plurality of individual mixing chamber means communicating with both said first and second chamber means for mixing said gas from said second chamber means and said first gas liquid mixture from said first chamber means to form an equilibrium two-phase mixture of gas and liquid in each of said individual mixing chamber means for ejection from said nozzle, and a plurality of orifice means downstream of and communicating with said plurality of individual mixing chamber means for ejection of the two-phase mixture from each said individual mixing chamber means to form said atomized spray.

2. The nozzle of claim wherein said nozzle is of cylindrical shape and has a longitudinal axis, and said plurality of orifice means comprise multiple pluralities of orifice means arranged in circles about said longitudinal axis with the orifice means in each successively-wider circle being arranged to eject said second two-phase mixture at successively wider angles to said longitudinal axis.

3. The nozzle of claim 2 wherein individual orifice means in each circle are substantially equally-arcuately spaced one from another.

4. The nozzle of claim 3 wherein individual orifice means in each circle are circular.

5. The nozzle of claim 4 wherein all said orifice means have the same diameter.

6. The nozzle of claim 4 wherein orifice means in outer circles each has a larger diameter than orifice means in inner circles.

7. The nozzle of claim 2 wherein each circle of orifice means is arranged at a different angle with respect to each other to effect the ejection of the two-phase gas mixture.

8. The nozzle of claim 7 including an orifice means located on said longitudinal axis.

9. The nozzle of claim 2 wherein:

said first chamber means comprises a single cylindrical chamber means axially-extending within said nozzle from an inlet end for communicating with the source of liquid to an outlet end, said second chamber means comprises a single annular chamber means axially extending within said nozzle concentrically with said single cylindrical chamber means and having an opening in an exterior side wall thereof for communicating with the source of gas, and said passage means extending between said second chamber means and said first chamber means comprises at least one opening formed through a common external wall of said single cylindrical chamber means and internal wall of said single annular chamber means.

10. The nozzle of claim 9 wherein said plurality of individual mixing chamber means is provided by individual pipes extending from said outlet end of said single cylindrical chamber means to said plurality of orifice means and having a plurality of openings formed through the wall of each of the individual pipes communicating with said single annular chamber means.

11. The nozzle of claim 10 wherein said plurality of openings in each of said individual pipes communicates with a common gas chamber means, said common gas chamber means is separated from said single annular chamber means by internal wall means, and a plurality of axially-directed passages is provided through said internal wall means extending between said common gas chamber means and said single annular chamber means to permit gas flow to said common gas chamber means.

12. A nozzle for the formation of an atomized spray of, fine liquid droplets in a continuous gaseous phase or of fine gas bubbles in a continuous liquid phase, said nozzle being of cylindrical shape and having a longitudinal axis, which comprises:

first chamber means for communicating with a source of liquid, second chamber means for communicating with a source of gas, passage means extending between said second chamber means and said first chamber means for premixing the gas and liquid in said first chamber means to form a first mixture of gas and liquid, a plurality of individual mixing chamber means communicating with both said first and second chamber means for mixing said gas from said second chamber means and said first gas/liquid mixture from said first chamber means to form an equilibrium two-phase mixture of gas and liquid in each of said individual mixing chamber means for ejection from said nozzle, and a plurality of orifice means downstream of and communicating with said plurality of individual mixing chamber means arranged for ejection of the two-phase mixture from each said individual mixing chamber means substantially perpendicularly to said longitudinal axis to form said atomized spray.

13. The nozzle of claim 12 wherein each of said orifice means is substantially equally arcuately spaced from one another.

14. The nozzle of claim 13 wherein:

said first chamber means comprises a single cylindrical chamber means axially-extending within said nozzle from an inlet end for communicating with the source of liquid to an outlet end, said second chamber means comprises a single annular chamber means axially extending within said nozzle concentrically with said single cylindrical chamber means and having an opening in an exterior side wall thereof for communicating with the source of gas, and said passage means extending between said second chamber means and said first chamber means comprises at least one opening formed through a common external wall of said single cylindrical chamber means and internal wall of said single annular chamber means.

15. The nozzle of claim 14 wherein said plurality of individual mixing chamber means is provided by individual pipes extending from said outlet end of said single cylindrical chamber means to said plurality of orifice means and having a plurality of openings formed through the wall of each of the individual pipes communicating directly with said single annular chamber means,.

16. A nozzle of generally cylindrical shape for the formation of an atomized spray of fine liquid droplets in a continuous gaseous phase or of fine gas bubbles in a continuous liquid phase, which comprises:

first chamber means comprising a single cylindrical chamber means axially extending within said nozzle from an inlet end for communicating with source of liquid to an outlet end, second chamber means comprising a single annular chamber means axially extending within said nozzle concentrically with said single cylindrical chamber means and having an opening in an exterior side wall thereof for communicating with a source of gas, third chamber means separated from said second chamber means by annular internal wall means, a plurality of axially-directed passages through internal wall extending between said second and third chamber means for flow of gas from said second chamber means to said third chamber means, a plurality of individual mixing chamber means communicating with the outlet end of said first chamber means for receiving liquid therefrom and said third chamber means for receiving gas therefrom and for mixing the gas and liquid to form a two-phase mixture of the gas and liquid in each of the individual mixing chamber means for ejection from said nozzle, and a plurality of orifice means downstream of and communicating with said plurality of individual mixing chamber means for ejection of the two-phase mixture from each said individual mixing chamber means to form the atomized spray.

17. The nozzle of claim 16, wherein passage means extends between said second chamber means and said first chamber means comprising at least one opening formed through a common external wall of said first chamber means and internal wall of said second chamber means for pre-mixing the gas and liquid in said first chamber means to form a first two-phase mixture of gas and liquid.

18. The nozzle of claim 16, wherein said plurality of individual mixing chamber means is provided by individual pipes extending from said outlet end of said first chamber means to said plurality of orifice means and having a plurality of openings formed through the wall of each of the individual pipes communicating with said third chamber means.

19. The nozzle of claim 18 wherein each of said orifices is circular and is of the same diameter as and communicates directly with said plurality of individual pipes.

20. A method of forming an atomized spray of fine liquid droplets in a continuous gaseous phase or of fine gas bubbles in a continuous liquid phase, which comprises:

feeding a liquid and a gas to a first gas-liquid mixing zone and forming a first mixture of gas and liquid in said first gas-liquid mixing zone, feeding said first gas-liquid mixture and a gas to a plurality of individual second gas-liquid mixing zones and forming an equilibrium two-phase mixture of gas and liquid in each of said individual second gas-liquid mixing zones, and ejecting said two-phase mixture from each of said individual second gas-liquid mixing zones through orifices to form said atomized spray.

* * * * *